US005634275A

United States Patent [19]

Pine

[11] Patent Number: 5,634,275

[45] Date of Patent: Jun. 3, 1997

[54] COMBINATION OF TWO TOOLS

[76] Inventor: Eli S. Pine, 370 River Rd., Nutley, N.J. 07110

[21] Appl. No.: 623,626

[22] Filed: Mar. 28, 1996

[51] Int. Cl.[6] ..... A61B 17/50; B25F 1/04

[52] U.S. Cl. ..... 30/145; 30/28; 30/125; 606/211

[58] Field of Search ..... 30/134, 26, 28, 30/29, 145, 146, 125; 132/73.5; 606/211

[56] References Cited

U.S. PATENT DOCUMENTS

| | | | |
|---|---|---|---|
| 768,083 | 8/1904 | Sickles | 30/29 |
| 789,539 | 5/1905 | Harris | 606/211 |
| 880,659 | 3/1908 | Hammergren | 606/211 |
| 1,084,923 | 1/1914 | Bowman | 20/28 |
| 1,828,121 | 10/1931 | Adam et al. | 30/29 |
| 2,999,505 | 9/1961 | Herstedt | 132/73.5 |
| 3,316,634 | 5/1967 | Bliss | 30/28 |
| 4,117,591 | 10/1978 | Terry | 30/124 |
| 4,847,994 | 7/1989 | Dunn, Jr. | 30/28 |
| 5,546,658 | 8/1996 | MacLeod et al. | 30/28 |

FOREIGN PATENT DOCUMENTS

| | | | |
|---|---|---|---|
| 333364 | 2/1921 | Germany | 606/211 |

*Primary Examiner*—Hwei-Siu Payer
*Attorney, Agent, or Firm*—Walter J. Tencza, Jr.

[57] ABSTRACT

This invention combines the nail clipper and the tweezer into one unit. The tweezer part of the Twipper is in the space between the opposing metal parts of the nail clipper, and is held in place by the post that anchors the lever in between the opposing metal parts. The tweezer does not effect the operation of the clipper unit it is rotated 180°, extending through the jaws of the clipper. At this position, exerting force on the lever, which compresses the jaws of the clipper, forces together the jaws of the tweezer (scissor, etc.).

21 Claims, 1 Drawing Sheet

COMBINATION OF TWO TOOLS

BACKGROUND

1. Field of Invention

This invention relates to two commonly used objects, the tweezer, such as the little instrument used for pulling hairs out, plucking eyebrows, etc., for the handling of tiny objects such as hearing aid batteries, precious stones, etc., and the clipper, commonly called a nail clipper, used for clipping finger nails. The name "Twipper" is merely a compression of the two names of the above mentioned items. Both the tweezer and the clipper has been in use for centuries and is commonly known throughout the world. This invention combines both items into one item. A scissor, plier, or any other tool can replace the tweezer.

2. Description of Prior Art

As above mentioned, both objects are simplicity personified, the tweezer is two pieces of metal welded together with an opening on one end. Upon applying pressure to force the open ends together, the two ends grasp an object, be it unwanted facial hair, a tiny splinter embedded in the skin, or a diamond. The clipper, commonly called a nail clipper, is also composed of two metal pieces welded together on one end, the open end consisting of sharp edges designed to cut, or clip, nails. An additional lever is mounted on the back of one piece so that much less force is required to squeeze together the sharp edges on the open ends. The tweezer is thousands of years old, perhaps even found with Egyptian artifacts. The nail clipper is perhaps only centuries old, requiring a certain amount of advanced metal processing. This inventor knows of no prior art that has combined both implements into one unit, as is this invention.

SUMMARY OF THE INVENTION

It is the object of this invention to provide both attributes of the tweezer and the clipper into one unit. The tweezer, the smaller of the two, is conveniently secreted into the body of the clipper, in the space between the opposing metal pieces of the clipper. The tweezer is held by the pin commonly used to hold the lever of the clipper in place. In this new configuration for the clipper to be used, the tweezer (scissor, etc.), being in reverse position, does not interfere with the clipper open end. For the tweezer to be used, the tweezer is rotated 180° and appears through the mouth of the clipper. Using the tweezer lever to compress the clipper jaws, the clipper jaws compress the tweezer jaws grasping (or cutting, etc..) the object between the jaws.

BRIEF DESCRIPTION OF DRAWINGS

The present invention will be more fully understood by the following description of drawings wherein.

DESCRIPTION OF THE PREFERRED EMBODIMENT

Figure 1:
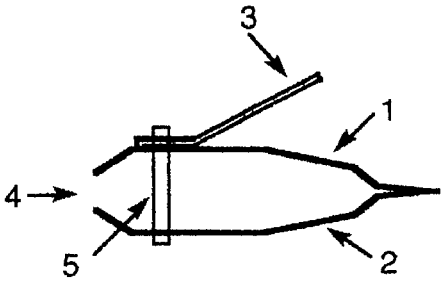
FIG. 1 is a side view of a nail clipper.
Figure 2:
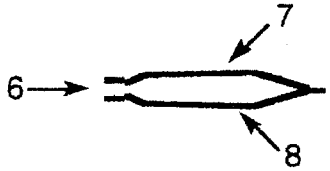
FIG. 2 is a side view of a tweezer.
Figure 3:
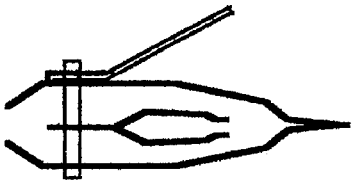
FIG. 3 is a side view of the combined tweezer and clipper. The tweezer is held in place by the clipper post. The tweezer jaws are in the reverse position to the clipper jaws. The clipper is used and the tweezer is not in use.
Figure 4:
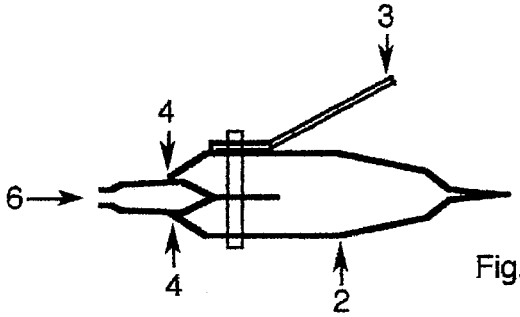
FIG. 4 shows the tweezer in use, having been rotated 180° sideways. When the clipper jaws are forced together, the clipper jaws compress the tweezer jaws. Force on the clipper lever compresses the tweezer jaws. Rotating the tweezer 180° sideways brings back the use of the clipper.
Figure 5:
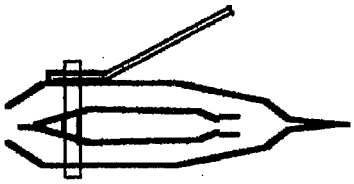
FIG. 5 shows the tweezer held by both opposing metal sides for greater stability.
Figure 6:
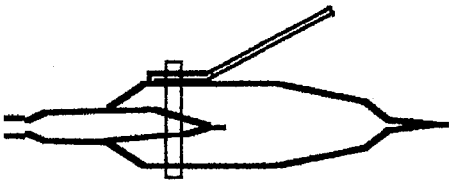
FIG. 6 shows the tweezer rotated sideways 180° ready to operate in the jaws of the clipper.
Figure 7:
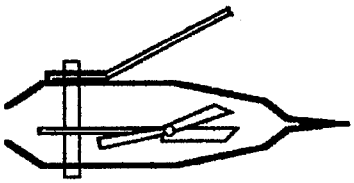
FIG. 7 shows a scissor within the clipper, the clipper in operating position.
Figure 8:
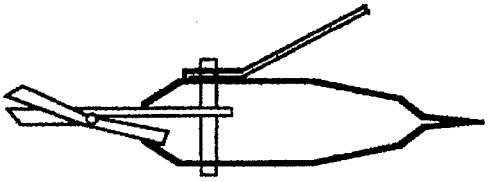
FIG. 8 shows the scissor rotated sideways 180° and ready to cut.

The object of this invention is the convenience of having the use of a nail clipper and a tweezer (scissor, etc.) in one unit instead of two. A great variety of tools can be in place besides the tweezer, e.g. scissors, pliers, screw driver, knife, saw, file, needle, awl, hooks etc. Several such aforementioned tools can simultaneously be stowed within the clipper body and rotated out of the clipper body for use. FIG. 1 shows a side view of the parts of a nail clipper. Members 1 and 2 are the opposing pieces of metal joined on one end. Member 3 is the lever used to compress the jaws, 4. Member 5 is the post separating the opposing parts 1 and 2, holding firm the lever 3. FIG. 2 shows a side view of a tweezer. Members 7 and 8 are pressed together closing the jaws, member 6. FIG. 3 is a side view of the combined clipper and tweezer. The tweezer jaws are held by the post (5) and is 180° in reverse position to that of the clipper jaws. The clipper is used in this position. FIG. 4 is a side view showing the tweezer jaws rotated 180° and extending through the jaws of the clipper. From pressure exerted on the lever (3) and the bottom of the clipper (2), the clipper jaws (4) force together the tweezer jaws (6). To use the clipper again, the tweezer is rotated 180° with respect to the post (5). FIG. 7 shows the scissor stowed within the clipper. FIG. 8 shows the scissors in extended operating (cutting) position. The clipper and the tweezer, or other tool are preferably combined together in one unit. The tweezer is preferably located within the clipper. The tweezer is preferably held by the post. The tweezer can be rotated into the jaws of the nail clipper. The movement of the lever on the nail clipper preferably forces the nail clipper jaws to close onto the body of the tweezer (scissors, tool, etc.), which closes the jaws of the tweezer or other tool. The tweezer is preferably rotated to be stowed within the body of the nail clipper.

I claim:

1. An apparatus comprised of:

a nail clipper comprising a first set of jaws and a lever, the lever during operation comprising a flat portion and an inclined portion, which portions form a substantial angle with respect to each other:

a tweezer;

a post;

said tweezer and said lever being connected to the post; and said tweezer being movable out of said nail clipper and extending outward through the first set of jaws for use, so that the tweezer is operated by compressing the first set of jaws.

2. The apparatus of claim 1 wherein:

the flat portion of the lever is connected to the post.

3. The apparatus of claim 1 wherein the tweezer is rotatably connected to the post and wherein the tweezer can be rotated so that the tweezer extends outward through the first set of jaws of the nail clipper.

4. The apparatus of claim 1 wherein:

the nail clipper comprises a first set of jaws at a first end of the nail clipper and the post is located nearest the first end.

5. The apparatus of claim 1 wherein:

the tweezer fits within the nail clipper.

6. An apparatus comprising:

a first tool comprising a first set of jaws;

a second tool;

means for connecting said second tool within said first tool; and said second tool being movable out of said first tool and extending outward through the first set of jaws for use, so that the second tool is operated by compressing the first set of jaws.

7. The apparatus of claim 6 and wherein:

the second tool comprises a second set of jaws;

and the first and second tools are connected so that when the first set of jaws of the first tool are compressed, the second set of jaws of the second tool are operated.

8. The apparatus of claim 7 and wherein:

the second set of laws of the second tool are compressed in response to the compression of the first set of laws of the first tool.

9. The apparatus of claim 6 wherein:

the first tool is a nail clipper.

10. The apparatus of claim 9 wherein:

the second tool is a tweezer.

11. The apparatus of claim 10 wherein:

the tweezer fits within the nail clipper.

12. The apparatus of claim 9 wherein:

the nail clipper comprises a lever, the lever during operation comprising a flat portion and an inclined portion, which portions form a substantial angle with respect to each other.

13. The apparatus of claim 12 wherein:

the second tool is a tweezer.

14. The apparatus of claim 13 further comprising:

a post;

the tweezer connected to the post; and the lever connected to the post.

15. The apparatus of claim 14 wherein:

the flat portion of the lever is connected to the post.

16. The apparatus of claim 14 wherein the tweezer is rotatably connected to the post and the tweezer can be rotated so that the tweezer extends outward through the first set of jaws of the nail clipper.

17. The apparatus of claim 14 wherein:

the first set of jaws is disposed at a first end of the nail clipper and the post is located nearest the first end.

18. The apparatus of claim 9 wherein:

the second tool is a set of scissors.

19. An apparatus comprising:

a first tool comprising a first set of jaws;

a second tool;

means for connecting the first and second tools so that the second tool may be operated and used by compressing the first set of jaws of the first tool; and wherein the first tool is a nail clipper and the second tool is a set of scissors.

20. A method comprising the steps of:

placing a second tool within a first tool, the first tool being comprised of a first set of jaws;

moving the second tool in a position extending outward through the first set of jaws of the first tool; and compressing the first set of jaws of the first tool to cause the operation and use of the second tool.

21. The method of claim 20 wherein the second tool is comprised of a second set of jaws and the step of compressing the first set of jaws of the first tool causes the second set of jaws of the second tool to compress.

* * * * *